US005362931A

United States Patent [19]

Fries

[11] Patent Number: 5,362,931

[45] Date of Patent: Nov. 8, 1994

[54] PANEL SHAPED ELEMENT, SPECIFICALLY FOR SOUND ABSORBING STRUCTURES AND A SOUND ABSORBING INSTALLATION

[76] Inventor: Arthur Fries, Am See, 6062 Wilen, Switzerland

[21] Appl. No.: 190,690

[22] Filed: Feb. 2, 1994

Related U.S. Application Data

[63] Continuation of Ser. No. 850,094, Mar. 12, 1992, abandoned.

[30] Foreign Application Priority Data

Mar. 20, 1991 [CH] Switzerland ..... 854/91

[51] Int. Cl.[5] ..... E04B 1/82

[52] U.S. Cl. ..... 181/284; 181/293

[58] Field of Search ..... 181/284, 286, 288, 290, 181/292, 293

[56] References Cited

U.S. PATENT DOCUMENTS

| | | | |
|---|---|---|---|
| 1,554,179 | 9/1925 | Trader | 181/293 |
| 1,825,770 | 10/1931 | Barnett | 181/293 |
| 2,165,101 | 7/1939 | Hudson | 181/293 |
| 2,280,631 | 4/1942 | Coffey | 181/293 |
| 3,103,255 | 9/1963 | Boschi et al. | 181/293 |
| 3,269,484 | 8/1966 | Lighter | 181/290 |
| 3,287,869 | 11/1966 | Kilgore | 181/287 |
| 3,991,848 | 11/1976 | Davis | 181/286 |
| 4,556,558 | 1/1986 | Link et al. | 181/210 |
| 4,842,097 | 6/1989 | Woodward et al. | 181/286 |

FOREIGN PATENT DOCUMENTS 1398330 6/1975 United Kingdom .

*Primary Examiner*—Michael L. Gellner
*Assistant Examiner*—Eddie C. Lee
*Attorney, Agent, or Firm*—Ostrolenk, Faber, Gerb & Soffen

[57] ABSTRACT

The panel shaped element finds application specifically for sound absorbing installations. It includes recesses proceeding from both its main surfaces which meet within the element and partially overlap each other. The recesses at one of the sides of the element have, thereby, shapes which differ from the shapes of the recesses at the other side thereof, such that the recesses form passages through the element. The recesses at the absorbing side are arranged in rows and the rows are arranged in a raster-like fashion. One of the sides of the element includes bores and the other side includes grooves. The bores are thereby arranged in rows parallel to the grooves and open into the grooves. Therefore, this panel shaped element can quite easily be selectively designed to cope with specific demands and circumstances by a changing of the relevant diameters.

9 Claims, 5 Drawing Sheets

PANEL SHAPED ELEMENT, SPECIFICALLY FOR SOUND ABSORBING STRUCTURES AND A SOUND ABSORBING INSTALLATION

This is a continuation of application Ser. No. 07/850,094, filed on Mar. 12, 1992, now abandoned.

BACKGROUND OF THE INVENTION

1. Field of the Invention

The present invention relates to a panel shaped element, specifically for sound absorbing structures and to a sound absorbing installation.

2. Description of the Prior Art

Generally known are panel shaped elements which include through bores. The prior art includes also tube chipboards having grooves at their visible side or offset, continuous slots, resp.. Further known are longitudinally and laterally grooved panels whereby the front side is longitudinally grooved and the backside is laterally grooved. Also known, furthermore, are panels structured of a porous material. All these known panel shaped elements can be varied in relatively restricted limits only in such a manner that they are suitable for a broad spectrum of acoustical problems, specifically for sound protection purposes.

Summary of the Invention

A general object of the present invention is to provide a panel shaped element, specifically for sound protection installations, in which the respective design of the elements is selectable by a changing of the relevant parameters to cope specifically with their object and with prevailing conditions.

A further object is to provide a panel shaped element which comprises two main surfaces and recesses extending from these main surfaces, which recesses meet each other inside of the element and partly overlap each other, whereby the recesses of one of the surfaces of the element are of a shape which differs from the shape of the recesses of the other surface in such a manner that the recesses form passages through the element.

Still a further object is to provide a sound absorbing installation having a plurality of such panel shaped elements.

BRIEF DESCRIPTION OF THE DRAWINGS

The present invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
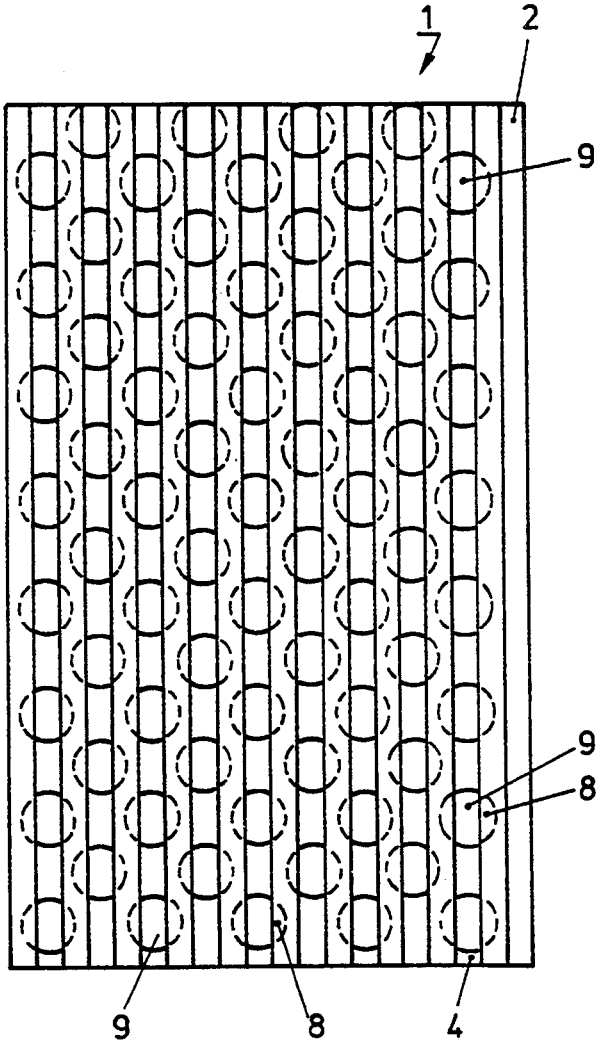
FIG. 1 is a top view of an acoustics element.
Figure 3:
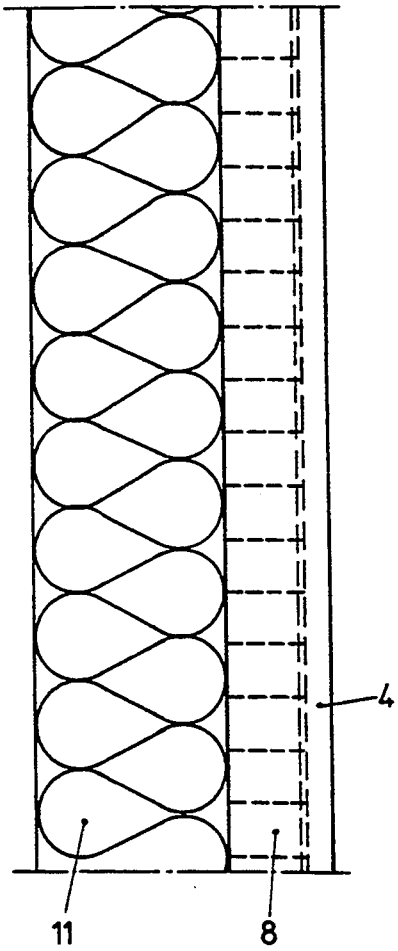
FIG. 3 is a side view of the element of FIGS. 1 and 2.
Figure 2:
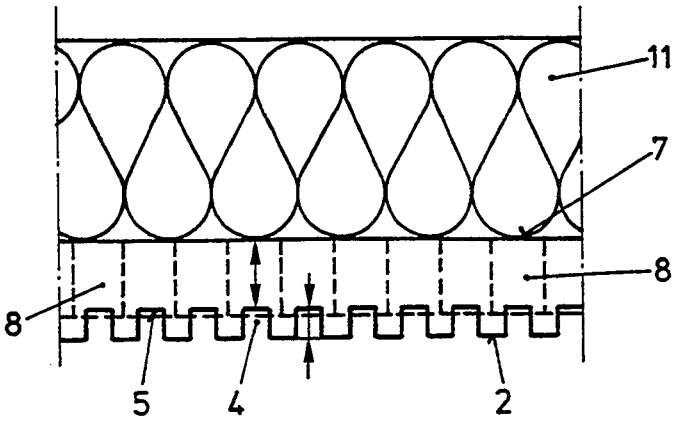
FIG. 2 is a front view of the acoustics element of FIG. 1 having a sound-absorbing glass or mineral wool mat.

The visible side of the acoustics element 1 illustrated in FIGS. 1 to 3 faces the room in which the source of sound is located. Grooves 4 extending in the longitudinal direction are set into this visible side 2, which grooves have a rectangular or square cross-section with a groove base 5 such as illustrated in FIG. 2.

The reverse side of the panel shaped acoustics element 1, the so called absorber side 7 is provided with bores 8 of which the axes of this embodiment extend in the center planes of the grooves 4 and perpendicularly to the longitudinal axes of the grooves 4. It is, however, also possible to arrange the axes of the bores 8 laterally offset and/or to drill them not perpendicularly, but obliquely relative to the longitudinal axis of the grooves 4.

While the bores 8 have a depth of about $\frac{2}{3}$ of the thickness of the plate, the depth of the grooves 4 amounts to about $\frac{1}{3}$ such as indicated and visible in FIG. 2. At the area where the grooves 4 and bores 8 overlap, passages 9 leading through the acoustics element are created through which passages 9 the energy to be attenuated penetrates from the one side of the panel therethrough to the other side.

The absorber side 7 is covered by a mineral or glass wool mat 11 such as illustrated in FIGS. 2 and 3, which mat serves as energy exterminator, here specifically as sound energy exterminator.

Figure 4:
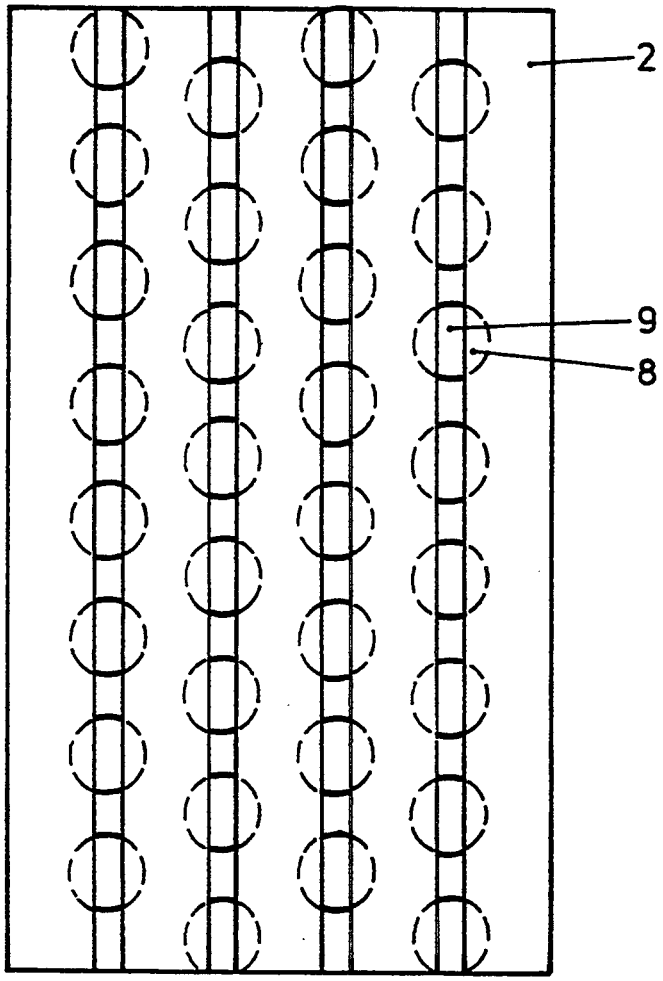
FIG. 4 illustrates a further embodiment of an acoustic element analogue to FIG. 1.
Figure 5:
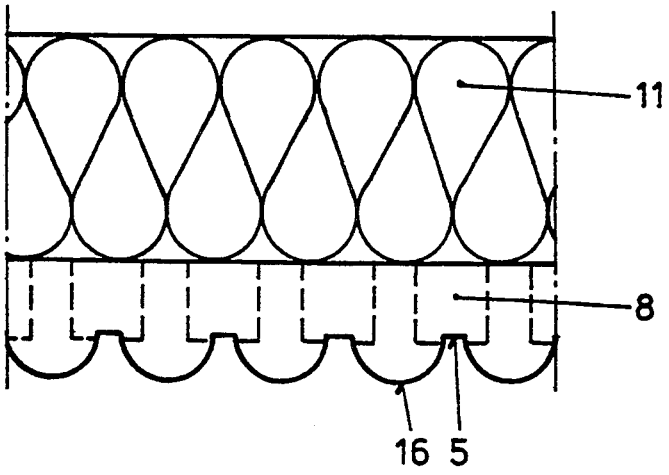
FIG. 5 is a front view of the element of FIG. 4 analogue to FIG. 2.

A further pattern of the forming of the passages from the visible side of such an acoustics element as seen from the visible side is illustrated in FIGS. 4 and 5 having a differently designed raster of the bores at the absorber side and varying distances between the grooves at the visible side. Furthermore, the side areas to the groove bases 5 are interconnected by rounded end cover surfaces 16 which again leads to a specific effect regarding the extermination of energy.

Figure 6:
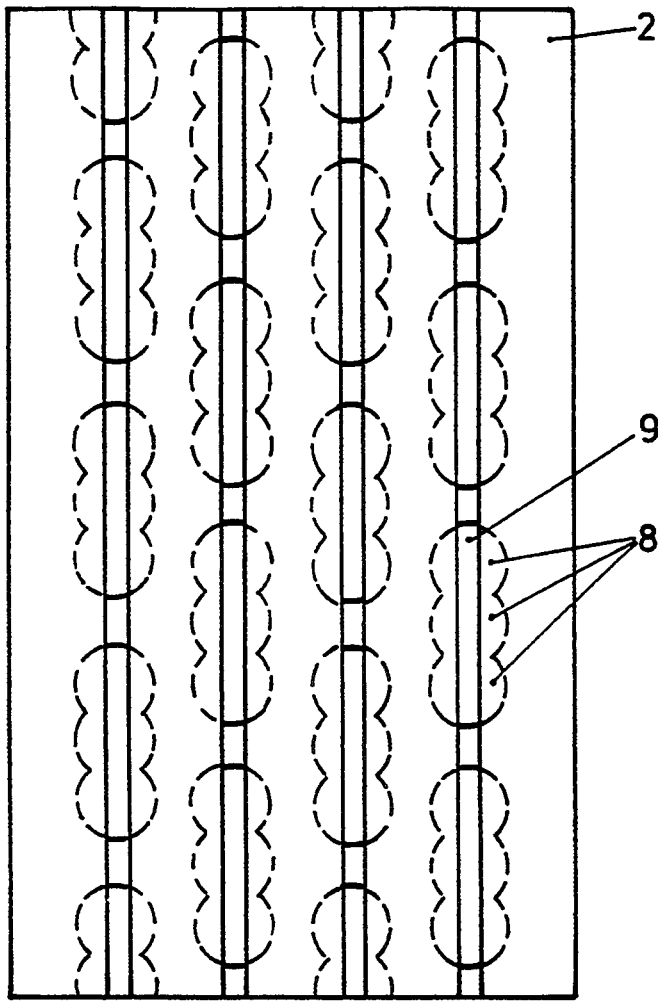
FIG. 6 illustrates a variant of an acoustics element analogue to FIGS. 1 and 4.
Figure 7:
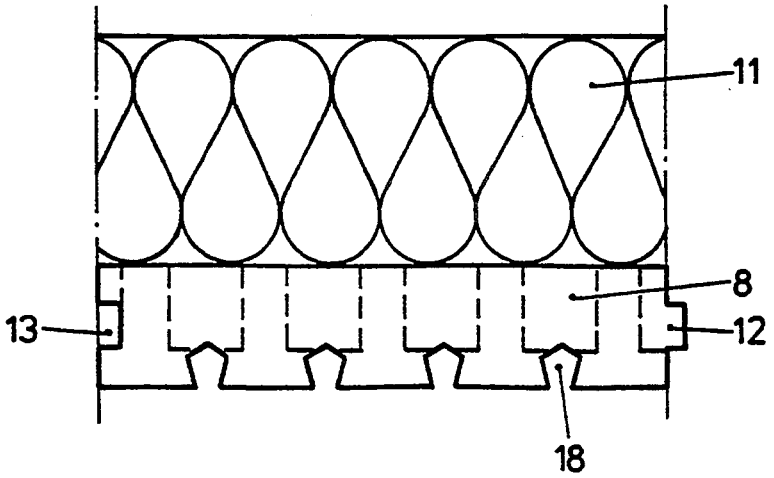
FIG. 7 is a front view of the element analogue to FIG. 6.

At the embodiment of a further variant according to FIGS. 6 and 7 the longitudinal grooves at the visible side 2 of the acoustics element comprise swallow tail like cross-sections 18 and the bores 8 overlap each other in a group-like fashion in such a manner that the passages 9 have corresponding longitudinal dimensions, a further possibility to suit the object to be solved by a changing of the shape and the location of the passages.

In FIG. 7 a lateral ridge 12 at the one longitudinal side and a corresponding groove 13 at the other longitudinal side are additionally depicted, which allow an assembling of these elements to a more or less large surface.

Figure 8:
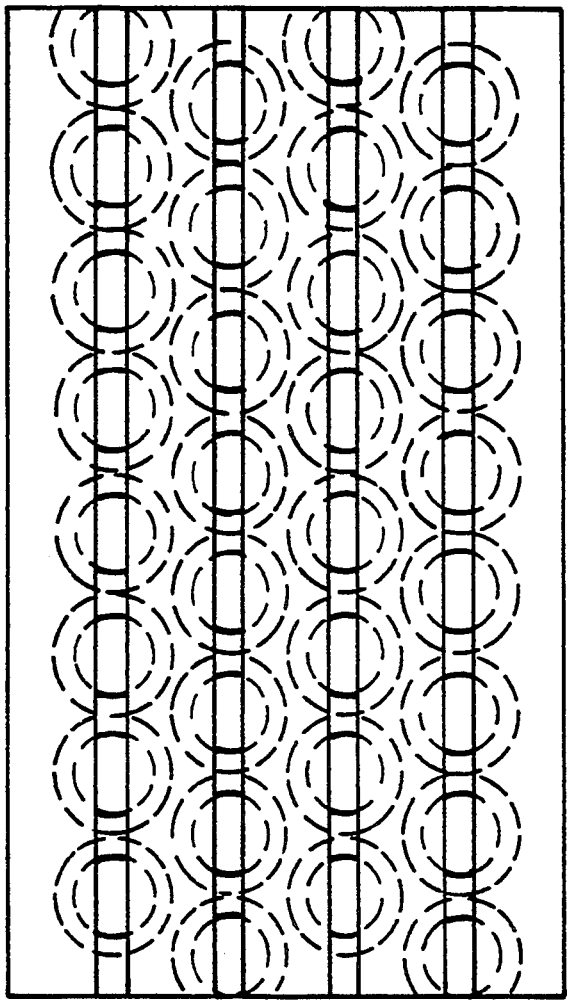
FIG. 8 illustrates a variant of an acoustics element analogue to FIGS. 1 and 4.
Figure 9:
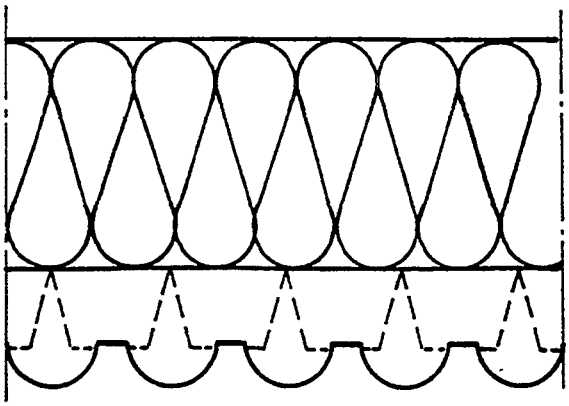
FIG. 9 is a front view of the element according to FIG. 8.

FIGS. 8 and 9 illustrate a further embodiment in which the bores are shaped as truncated cones or pyramids converging toward the inside of the acoustics element.

Figure 10:
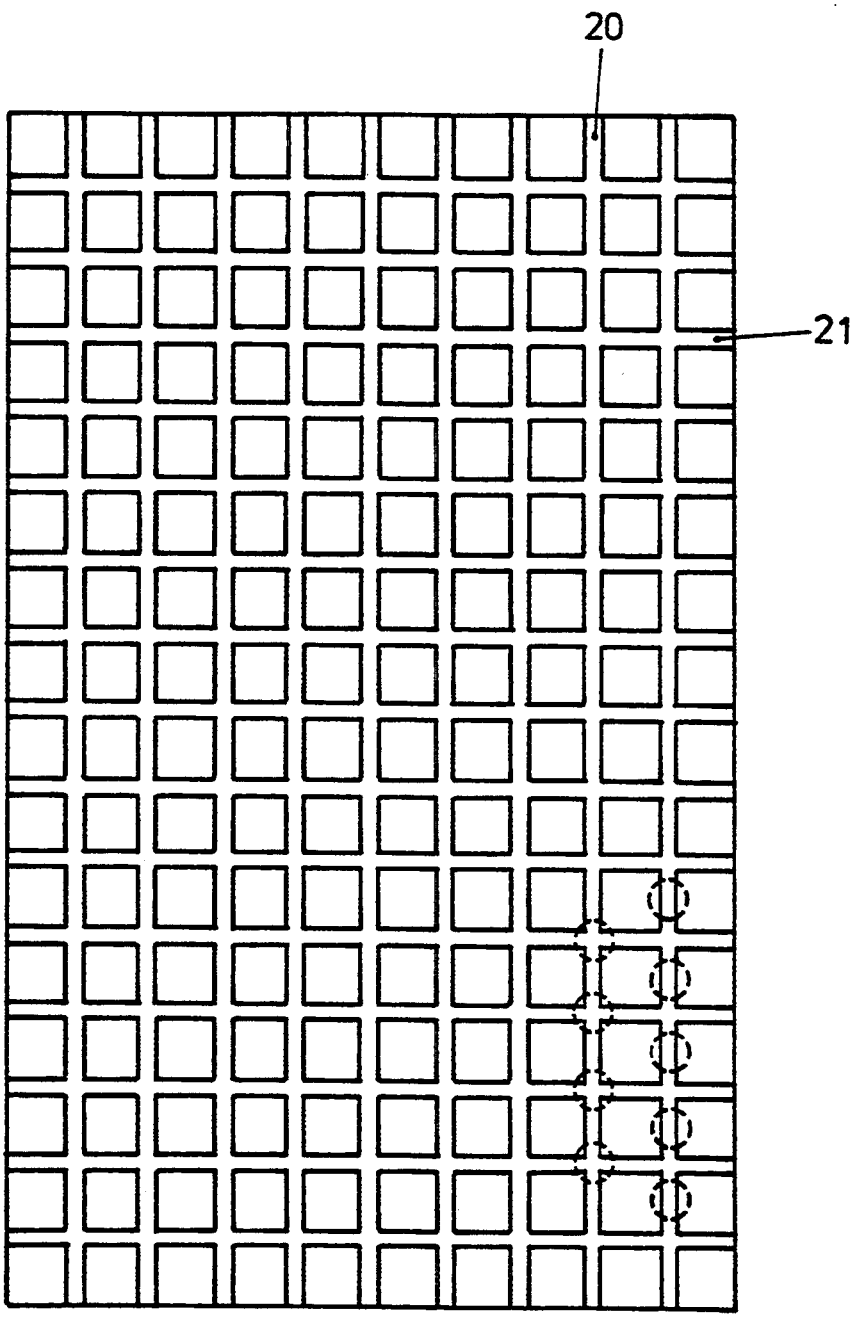
FIG. 10 is a front view of an element analogue to FIG. 1 having a specifically appealing pattern of the recesses at the visible surface.

FIG. 10 illustrates the front surface of an element. It is quite pleasing in that the recessed lateral and longitudinal grooves 20 and 21 form squares. The base of the grooves can possibly be colored. It obviously is also possible to design the grooves in such a manner that lying or upstanding rectangles are formed. This will depend from the specifics of the room.

In summarizing, following is to be noted:

By a placing of differing recesses, at the one side at the visible side and at the other side at the absorber side of such elements and by the possibility of variations in the discussed sense, it is easily possible to change the characteristics regarding the sound attenuation and accordingly to make them to suit the local circumstances and the source of the sound.

Depending from the design of the element the absorber portion can be changed from 0 to 25% of the surface portion.

Sound, dampening elements are mounted in a sandwich like manner, whereby additionally a sound attenuating panel for instance in form of a chipboard or plaster board is placed onto the reverse side of the element, i.e. over the absorber mat (mineral or glass wool mat).

Such elements can also find use by a corresponding selection of material and shaping of the recess for a guiding and controlling of the sound energy, i.e. as so-called sound diffusors.

It has been proven that such acoustics elements are preferably manufactured of natural wood. By an optimal selection of massive wood the desired sound-technical effects can be optimized correspondingly. It is, however, also possible to use combined panels, such as plywood panels, chipboard panels, MDF-panels, etc. If necessary, specifically in case of easy burning objects, to make corresponding supporting panels with cement components, for instance "Duripanel" can be used. It is also possible to realize by a corresponding selection of materials sound technical solutions on biological bases.

Such acoustics elements can be designed on a large size basis, for instance in lengths of up to 5 Meters and widths of 100 to 200 Millimeters and thicknesses of 12 to 20 Millimeters. Above dimensions are to be taken only as examples.

The visible side of the elements can be variably designed regarding depth of the grooves, width of the grooves, distance between grooves, inclination of the grooves, also regarding the profile of the surface, e.g. smooth, rounded, concave, convex, etc. and can be adjusted to suit the prevailing demands. The absorber side or reverse side of the elements can also be made to suit these demands with regard to position of the bores, depth of the bores, e.g. conical bores, diameter of bores and arrangement of the bores and shape of the bores, as well. By the combination of the grooves or profile, resp. at the visible side and perforations of the mentioned kind at the reverse side a respective optimal characteristic for solving a problem encountered is arrived at.

The surfaces of such elements can be varied as desired, i.e. they may be natural surfaces, laquered, stained, enameld, laquer coated, painted, etc.

While there are shown and described present preferred embodiments of the invention, it is to be distinctly understood that the invention is not limited thereto, but may be otherwise variously embodied and practiced within the scope of the following claims.

I claim:

1. A sound absorbing panel having a front surface and a rear surface, the front surface having a plurality of parallel grooves therein, the rear surfacing having, for each groove in the front surface, a row of bores aligned with and centered with respect to the groove, the bores in adjacent rows being staggered, a portion of the bottom of each bore opening into and communicating with a respective one of the grooves, the bottom of each bore opening into and communicating with the respective one of the grooves having a diameter at a point of intersection with the respective groove which is larger than the width of the groove.

2. The sound absorbing panel of claim 1, wherein the grooves have a swallow tail shaped cross-section.

3. The sound absorbing panel of claim 1, wherein the recesses are approximately twice as deep as the grooves.

4. The sound absorbing panel of claim 1, wherein the portions of the front surface which interconnect adjacent grooves have a part-round cross-section.

5. The sound absorbing panel of claim 1, wherein the recesses in each row are arranged in groups, the recesses in each group partially overlapping one another.

6. The sound absorbing panel of claim 1, wherein a first set of parallel grooves in the front surface perpendicularly intersects a second set of parallel grooves in the front surface so as to form a plurality of rectangles protruding from the front surface thereof.

7. The sound absorbing panel of claim 1 wherein the panel comprises wood.

8. A sound absorbing panel having a front surface and a rear surface, the front surface having one or more sets of a plurality of parallel grooves therein, and the rear surface having, for grooves in the front surface, rows of recesses lined with respect to the corresponding groove, said recesses in adjacent rows being staggered, a portion of the bottom of each recess opening into and communicating with the respective one of the grooves, the bottom of each recess opening into and communicating with a respective one of the grooves having a diameter at a point of intersection with the respective groove which is larger than the width of the groove.

9. A sound absorbing panel having a front surface and a rear surface, the front surface having a plurality of parallel grooves therein, and the rear surface having, for each groove in the front surface, a row of bores aligned with and centered with respect to the groove, the bores in adjacent rows being staggered, a portion of the bottom of each bore opening into and communicating with a respective one of the grooves, the portion of each of the bores opening into and communicating with a respective one of the grooves and visible from the front surface each forming a slotted aperture in the respective groove.

* * * * *